US006668541B2

(12) United States Patent
Rice et al.

(10) Patent No.: US 6,668,541 B2
(45) Date of Patent: Dec. 30, 2003

(54) METHOD AND APPARATUS FOR SPRAYING FUEL WITHIN A GAS TURBINE ENGINE

(75) Inventors: Edward Claude Rice, Indianapolis, IN (US); Robert Anthony Ress, Jr., Carmel, IN (US); Reginald Guy Williams, Indianapolis, IN (US)

(73) Assignee: Allison Advanced Development Company, Indianapolis, IN (US)

( * ) Notice: Subject to any disclaimer, the term of this patent is extended or adjusted under 35 U.S.C. 154(b) by 0 days.

(21) Appl. No.: 10/096,530

(22) Filed: Mar. 11, 2002

(65) Prior Publication Data

US 2003/0019205 A1 Jan. 30, 2003

Related U.S. Application Data

(60) Continuation of application No. 09/597,631, filed on Jun. 20, 2000, now abandoned, which is a division of application No. 09/132,455, filed on Aug. 11, 1998, now Pat. No. 6,125,627.

(51) Int. Cl.[7] ..... F23R 3/34
(52) U.S. Cl. ..... 60/207; 239/265.19
(58) Field of Search ..... 60/204, 231, 740, 60/761, 207; 239/265.19

(56) References Cited

U.S. PATENT DOCUMENTS

| | | | | |
|---|---|---|---|---|
| 2,771,740 A | | 11/1956 | Johnson | |
| 3,788,065 A | * | 1/1974 | Markowski | 60/39.02 |
| 4,720,971 A | * | 1/1988 | DuBell | 60/204 |
| 4,751,815 A | | 6/1988 | Moore | |
| 4,887,425 A | * | 12/1989 | Vdoviak | 60/261 |
| 4,901,527 A | | 2/1990 | Nash et al. | |
| 5,001,898 A | | 3/1991 | Holladay | |
| 5,052,176 A | | 10/1991 | Labatut et al. | |
| 5,076,062 A | | 12/1991 | Abreu | |
| 5,297,391 A | | 3/1994 | Roche | |
| 5,335,490 A | | 8/1994 | Johnson et al. | |
| 5,385,015 A | | 1/1995 | Clements et al. | |
| 5,396,761 A | | 3/1995 | Woltmann et al. | |
| 5,396,763 A | | 3/1995 | Mayer et al. | |
| 5,400,589 A | | 3/1995 | Mahias et al. | |
| 5,438,821 A | | 8/1995 | Schulte-Werning | |

FOREIGN PATENT DOCUMENTS

| | | |
|---|---|---|
| GB | 874502 | 8/1961 |
| GB | 2250086 A | 5/1992 |

* cited by examiner

*Primary Examiner*—Ehud Gartenberg
(74) *Attorney, Agent, or Firm*—Woodard, Emhardt, Moriarty, McNett & Henry LLP

(57) ABSTRACT

A fuel spraybar assembly for spraying fuel within a gas turbine engine. The spraybar assembly includes radial and lateral members that distribute fuel within the flowpath. In one embodiment two lateral members are located at the radially inward end of a radial member and generally form a "T" shape. Circumferentially spaced adjacent spraybars subdivide the flowpath into a plurality of circumferential combustion zone segments. In one embodiment the junction of the radial and lateral members provides a flameholding feature that stabilizes the combustion flame. In another embodiment, fuel is introduced non-uniformly within the afterburner resulting in thermal vectoring of the engine thrust.

11 Claims, 14 Drawing Sheets

METHOD AND APPARATUS FOR SPRAYING FUEL WITHIN A GAS TURBINE ENGINE

CROSS-REFERENCE TO RELATED APPLICATIONS

This application is a continuation of U.S. patent application Ser. No. 09/597,631, filed Jun. 20, 2000 now abandoned; which is a divisional of U.S. patent application Ser. No. 09/132,455, filed Aug. 11, 1998, now U.S. Pat. No. 6,125,627, which is incorporated herein by reference.

BACKGROUND OF THE INVENTION

The present invention relates generally to a method and apparatus for spraying fuel within a gas turbine engine, especially for spraying fuel within an afterburner of a jet engine. However, certain applications for the present invention may be outside of this field.

Some gas turbine engines have a need for increased thrust. One method of increasing thrust includes the injection and burning of fuel downstream of the low pressure turbine of the engine, in a method known variously as reheat, augmentation, or afterburning. Two features of the augmentor of a gas turbine engine are the fuel spraybar assemblies and flameholders, the spraybars spraying fuel into the flowpath of the engine, and the flameholders stabilizing the flame in the engine. Another feature of the afterburner is the augmentation fuel control system which should be capable of fuel metering from very low to very high fuel flow rates.

There is a continuing need for improvements to afterburning within gas turbine engines. The present invention provides novel and unobvious methods and apparatus for improvements to afterburners.

SUMMARY OF THE INVENTION

One embodiment of the present invention includes an apparatus including a gas turbine engine. The gas turbine engine has an afterburning portion for burning fuel. The apparatus also includes a fuel spraybar for spraying fuel within the afterburning portion, the fuel spraybar having a radially extending member for spraying fuel and a first lateral member. The radial member has two sides and the first lateral member is located on a first side of the radial member. The first lateral member is capable of spraying fuel in a generally radial direction.

One object of one form of the present invention is to provide an improved apparatus for spraying fuel into a gas turbine engine.

Related objects and advantages of the present invention will be apparent from the following description.

DESCRIPTION OF THE PREFERRED EMBODIMENT

Figure 1:
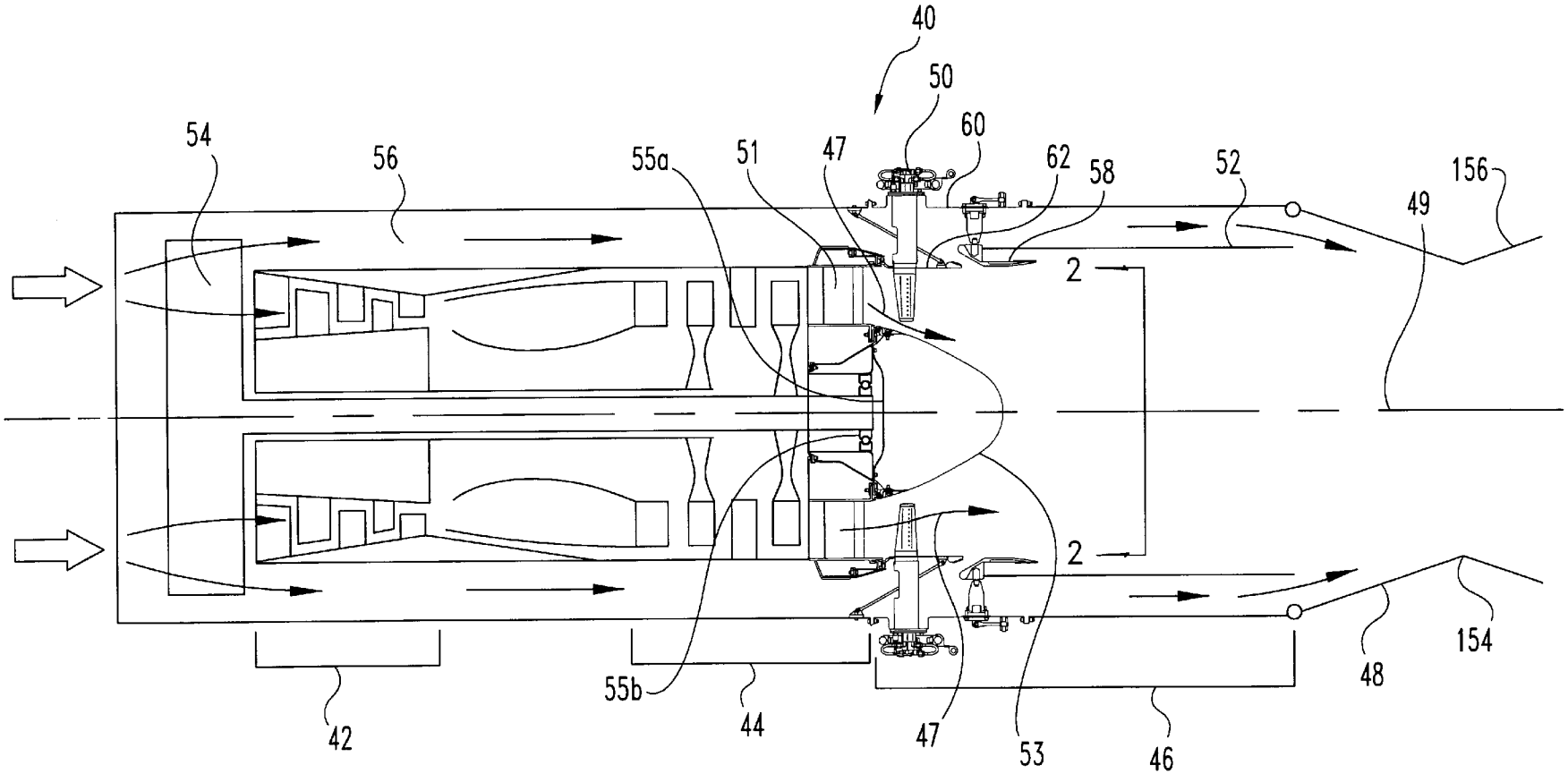
FIG. 1 is a cross-sectional schematic of a gas turbine engine according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 is a cross-sectional schematic of a gas turbine engine 40. Engine 40 includes a compressor section 42, a turbine section 44, and an augmentor for afterburning portion 46. Afterburning portion 46 includes a fuel spraybar assembly 50 that introduces fuel into flowpath 47 for burning and release of heat within augmentor 46. Flowpath 47 includes gases that have exited through turbine exit vanes 51 and has an outer periphery generally established by inner casing 62. A convergent nozzle 48 accelerates gas within flowpath 47 to sonic velocity in the vicinity of nozzle throat 154. In some embodiments, the present invention includes a divergent section 156 located aft of throat 154. Divergent section 156 can increase the velocity of gas exiting the engine if the flow is sonic in the vicinity of throat 154.

In some embodiments of the present invention, engine 40 includes a fan section 54 which provides air to both compressor 42 and bypass duct 56. Air within bypass duct 56 flows past the plurality of spraybar assemblies 50 and past an afterburner liner 52, and ultimately mixes with gases within flowpath 47. In some embodiments of the present invention there is a moveable variable bypass door 58 that permits a portion of the air in bypass duct 56 to mix with flowpath 47 in the general vicinity of spraybar assembly 50. In some embodiments of the present invention a portion of air from bypass duct 56 mixes with flowpath 47 upstream of fuel spraybar assemblies 50. Spraybar assemblies 50 are fastened to an outer casing 60 of engine 40, span across bypass 56, and protrude through inner casing 62. Inner casing 62 and liner 52 are air cooled to reduce their temperatures and include features such as segmentation for management of stresses from thermal gradients.

An aerodynamically shaped rear bearing cover 53 is located at the end of turbine section 44. Cover 53 provides for the expansion of flowpath 47 toward centerline 49 of engine 40 as the flowpath gases exit from vane 51. In the preferred embodiment of the present invention, spraybar assemblies 50 are located circumferentially around cover 53, so as to permit a shortening of the overall length of afterburning portion 46. A shorter overall length of afterburning portion 46 reduces the weight and cost of portion 46, and also reduces circumferential mixing and radial mixing of gases within flowpath 47 flowing within afterburning portion 46. Cover 53 is preferably a cooled structure that includes features for management of stresses induced by thermal gradients, although in some embodiments of the present invention it may be acceptable that cover 53 be fabricated from a high temperature material and include, for example, a thermal barrier coating. Located within cover 53 and also included within bearing assembly are a rear turbine bearing 55*b* and an intermediate bearing cover 55*a*. In some embodiments of the present invention spraybar assemblies 50 are located aft of bearing cover 53 so as to reduce the heat load into cover 53.

Figure 2:
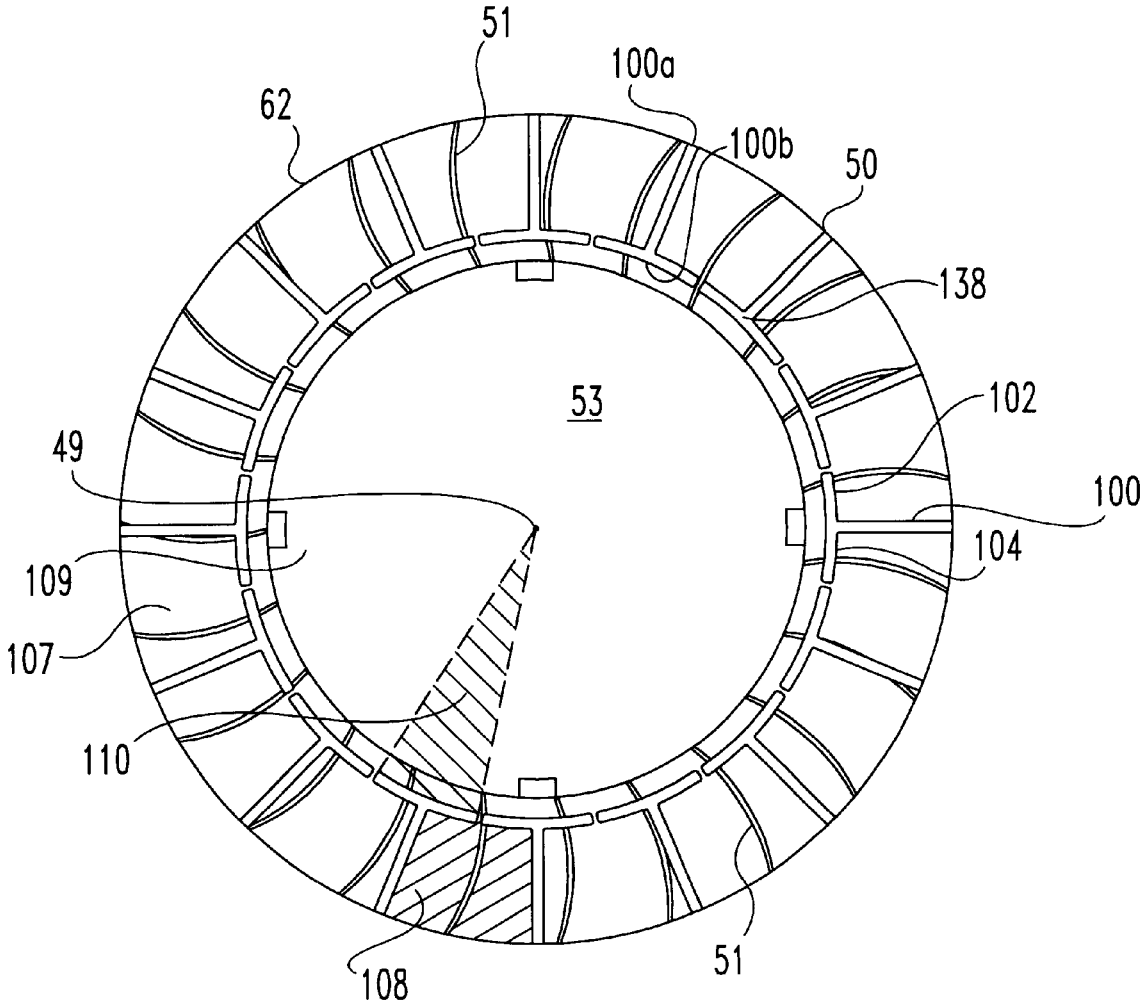
FIG. 2 is an elevational end view of the gas turbine engine of FIG. 1 as taken along line 2—2 of FIG. 1.

FIG. 2 is a view of the gas turbine engine 40 of FIG. 1 as taken along line 2—2 of FIG. 1. A plurality of spraybar assemblies 50 are shown aft of a plurality of turbine exit vanes 51, and generally surrounding turbine rear bearing cover 53. Each spraybar assembly 50 includes a radial member 100 with an outermost end 100*a* directed away from centerline 49 and proximate to inner casing 62. Each radial member 100 also includes an innermost end 100*b* directed toward centerline 49. Each assembly 50 also includes a first lateral member 102 extending in a generally circumferential direction from one side of innermost end 100*b*, and a second lateral member 104 extending in a generally circumferential direction opposite to that of first lateral member 102. Radial member 100 and lateral members 102 and 104 are shaped generally in the form of a "T", with lateral members 102 and 104 preferably being in an arc. It is preferable that radial member 100 and lateral members 102 and 104 be integrally cast from a high temperature material. However, the present invention also contemplates separate fabrication of members 100, 102, and 104, which would then be joined or fastened in a "T" shape in a manner known to those of ordinary skill in the art. Spraybar assemblies 50 are circumferentially spaced from one another such that the first lateral member 102 of one spraybar assembly 50 is directed toward a second lateral member 104 of an adjacent spraybar assembly 50.

Figure 3:
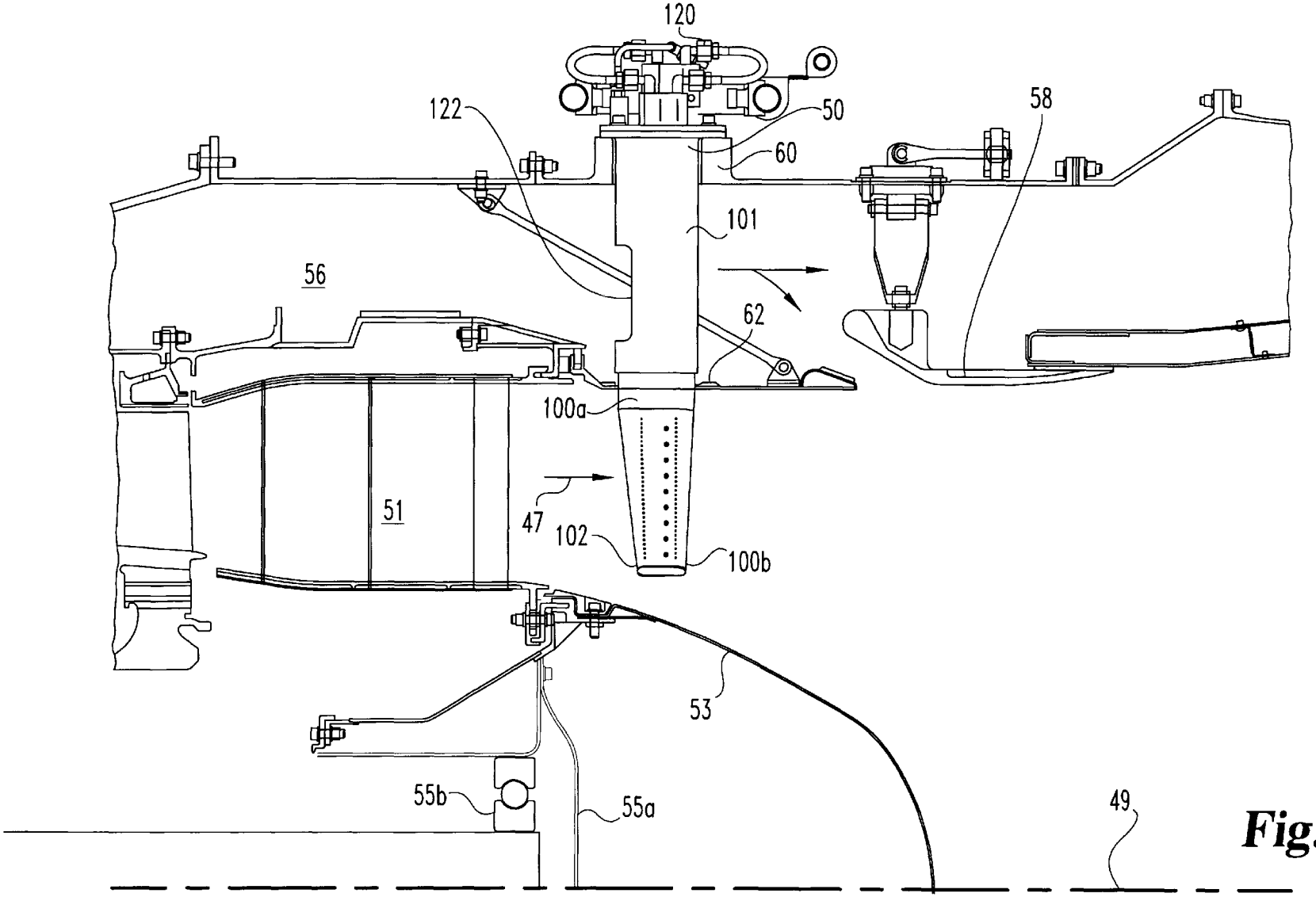
FIG. 3 is a partial enlargement of FIG. 1 in the vicinity of a spraybar assembly.

FIG. 3 is an enlargement of FIG. 1 in the vicinity of spraybar assembly 50. Spraybar assembly 50 includes an upper body 101 that is fastened to outer casing 60. Upper body 101 protrudes generally through bypass duct 56 and preferably includes cooling air inlet 122 for the introduction of air from bypass duct 56 into upper body 101 so as to cool radial member 100 and, in some embodiments lateral members 102 and 104. The present invention also contemplates gas turbine engines that do not incorporate a bypass duct 56. For those embodiments of the present invention it would be preferable to cool radial member 100 and lateral members 102 and 104 with a different source of cooling air, for example air bled from compressor section 42. Spraybar assembly 50 also includes an exterior portion 120 which is coupled to one or more fuel manifolds (not shown) of engine 40.

Figure 4:
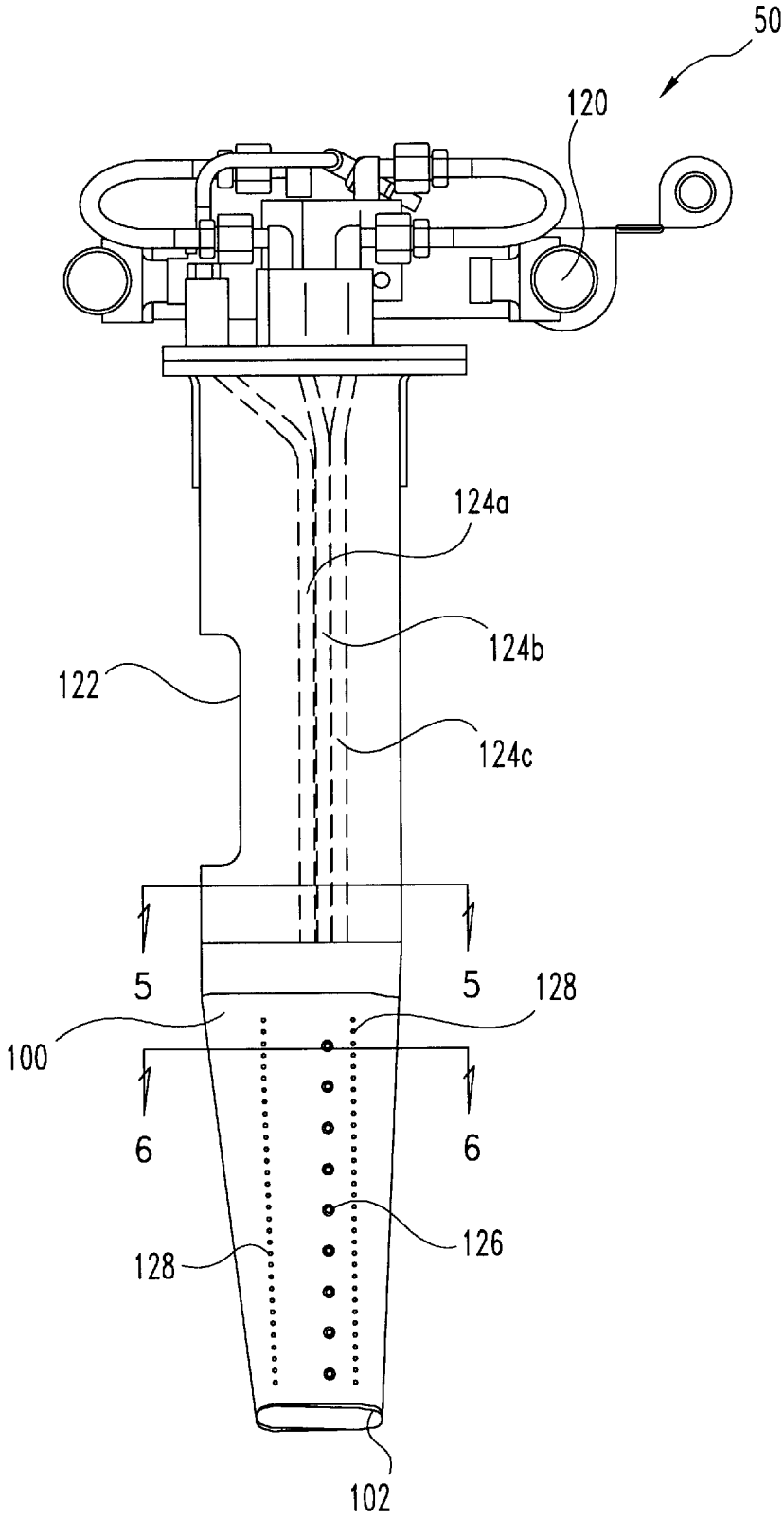
FIG. 4 is an elevational side view of the spraybar assembly of FIG. 1.

FIG. 4 is an elevational side view of a spraybar assembly. Fuel-handling exterior portion 120 of spraybar assembly 50 is in fluid communication with a plurality of fuel passageways 124 which provide fuel to radial arm 100 and lateral arms 102 and 104. Fuel passageway 124*c* provides fuel to a plurality of lateral fuel spray passages 126 which spray fuel in a generally lateral direction within flowpath 47 such that the spray of fuel is generally perpendicular to centerline 49. Cooling air inlet 122 provides cooling air from bypass duct 56 to a plurality of cooling air exhaust holes 128 located on both sides of radial member 100.

Figure 5:
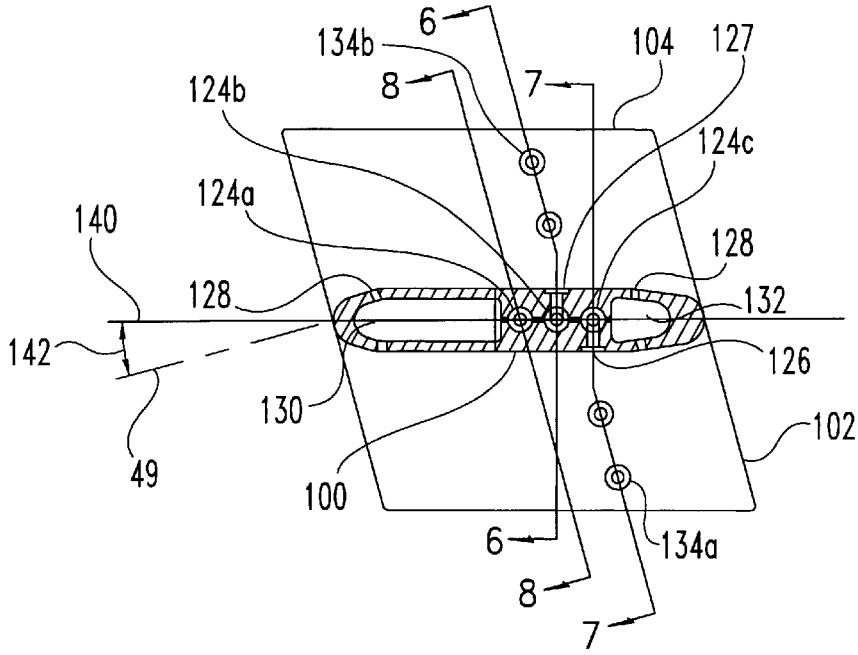
FIG. 5 is a cross-sectional view of the spraybar assembly of FIG. 4 as taken along line 5—5 of FIG. 4.

FIG. 5 is a cross-sectional view of the spraybar assembly of FIG. 4 as taken along line 5—5 of FIG. 4. Fuel passageway 124*b* is shown in fluid communication with a second set of lateral fuel spray passages 127, such that the spray of fuel is generally perpendicular to centerline 49. Forward cooling air channel 130 and aft cooling air channel 132, both of which are in fluid communication with air inlet 122, are arranged so as to exhaust cooling air through a plurality of exhaust holes 128 on radial member 100. The flow of cooling air through radial arm 100 helps maintain the temperature of fuel within fuel passageways below a coking temperature and also generally maintains member 100 within acceptable temperature limits. In some embodiments of the present invention cooling air is also provided from channels 130 and 132 to lateral members 102 and 104.

Radial member 100 includes a midplane 140 that is oriented at an angle 142 relative to center line 49 of engine 40. Orienting midplane 140 at angle 142 is useful in some embodiments of the present invention to assist in the deswirling of gas in flowpath 47 that has exited vanes 51. In other embodiments of the present invention midplane 140 may be parallel to center line 49.

Figure 6:
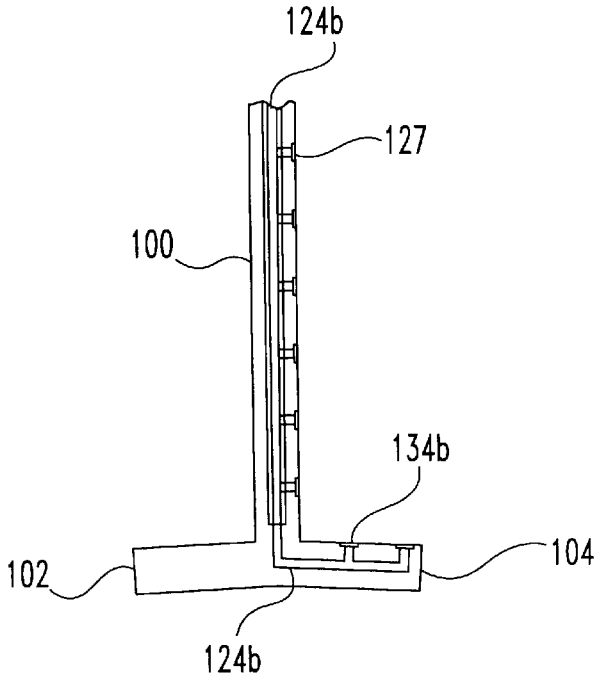
FIG. 6 is a cross-sectional view of the apparatus of FIG. 5 as taken along line 6—6 of FIG. 5.

FIG. 6 is a cross-sectional view of the apparatus of FIG. 5 as taken along line 6—6 of FIG. 5. Fuel passageway 124*b* is shown in fluid communication with second set of lateral fuel spray passages 127 and also upper radial fuel spray passages 134*b*. Passages 134*b* spray fuel in a direction generally perpendicular to centerline 49 and in a direction generally radially outward.

Figure 7:
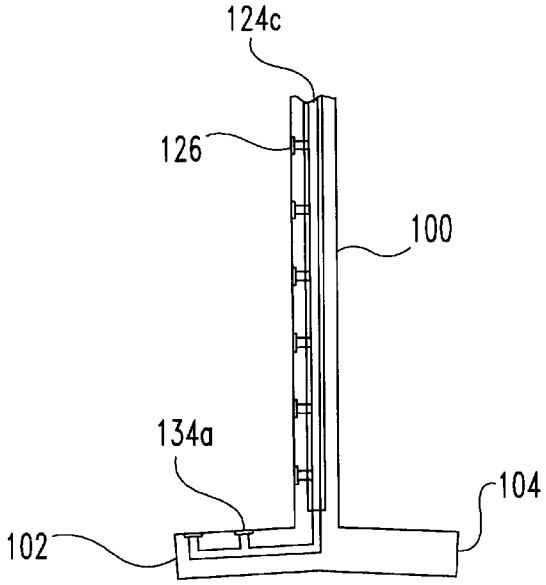
FIG. 7 is a cross-sectional view of the apparatus of FIG. 5 as taken along line 7—7 of FIG. 5.

FIG. 7 is a cross-sectional view of the apparatus of FIG. 5 as taken along line 7—7 of FIG. 5. Fuel passageway 124*c* is shown in fluid communication with first set of lateral fuel spray passages 126 and also first set of upper radial fuel spray passages 134*a*. Passages 134*a* spray fuel in a direction generally perpendicular to centerline 49 and in a direction generally radially outward.

Figure 8:
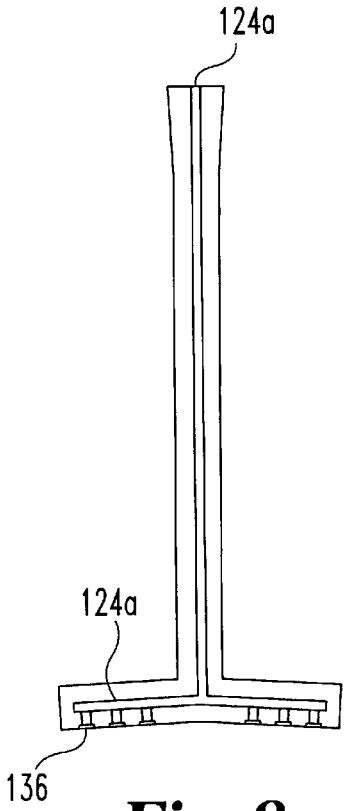
FIG. 8 is a cross-sectional view of the apparatus of FIG. 5 as taken along line 8—8 of FIG. 5.

FIG. 8 is a cross-sectional view of the apparatus of FIG. 5 as taken along line 8—8 of FIG. 5. Fuel passageway 124*a* is shown in fluid communication with a plurality of lower radial spray passages 136 on the underside, or radially inward side, of lateral members 102 and 104.

Figure 9:
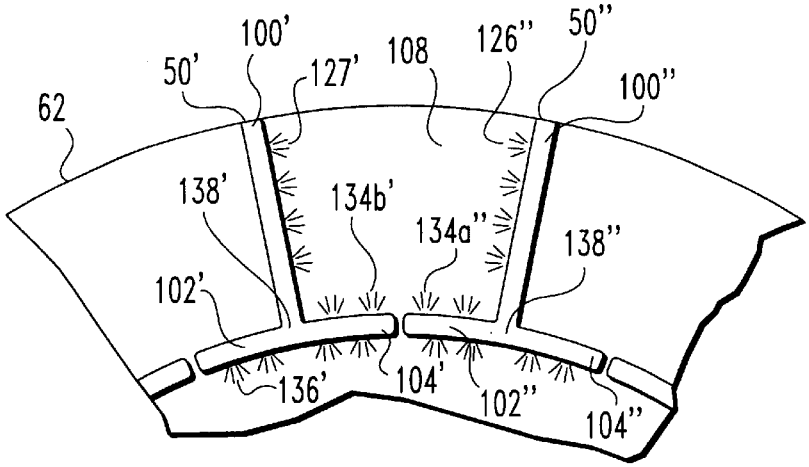
FIG. 9 is an enlarged portion of the view of FIG. 2 showing portions of two fuel spraybar assemblies.

FIG. 9 is an enlarged portion of the view of FIG. 2 showing portions of two fuel spraybar assemblies. A portion of a first spraybar assembly 50' is shown spaced circumferentially from a second spraybar assembly 50". A first radial member 100' protrudes past inner casing 62 into flowpath 47. In one embodiment of the present invention fuel passageways 124*b'* and 124*c"* (not shown) are in fluid communication. Fuel has been provided to fuel passageway 124*b',* and is shown spraying from second set of lateral fuel spray passages 127' and upper radial fuel spray passages 134*b'*. Fuel has also been provided to fuel passageway 124*c"* of assembly 50", and fuel is shown spraying from first sets of lateral fuel spray passages 126" and upper radial fuel spray passages 134*a"*. The sprayed fuel is combusted within a circumferential combustion zone 108 which is bounded by radial member 50', second lateral member 104', first lateral member 102", radial member 50", and inner casing 62.

In the embodiment of the present invention shown in FIG. 2, there are sixteen individual circumferential combustion zone segments 108. Flowpath 47 of engine 40 within afterburning portion 46 is divided into a first outer annulus 107 and inner cylinder 109. Inner casing 62 and the plurality of lateral members 102 and 104 define the outer and inner boundaries, respectively, of first outer annulus 107. The plurality of lateral members 102 and 104 define a generally radial boundary of inner cylinder 109. Radial members 100 further subdivide first outer annulus 107 into a plurality of spaced circumferentially extending combustion zone segments 108. These segments 108 begin generally between adjacent spraybar assemblies 50 and extend axially along centerline 49 through augmentor 46. There may be circumferential and radial mixing of the hot gases within the combusted segment 108 with cooler gases in adjacent segments or within inner cylinder 109. There may be further mixing as the hot gases of the reheated segment 108 pass through convergent nozzle 48. However, mixing is reduced because of the shorter overall length of afterburning portion 46.

By subdividing outer annulus 107 of flowpath 47 into a plurality of circumferentially extending combustion zone segments it is possible to divide the operation of afterburning portion 46 into at least sixteen discrete levels of operation. Dividing of the operation of afterburner 46 into sixteen different levels of operation permits fine tuning of the level of thrust generated from engine 40. This subdivision of flowpath 47 into a plurality of combustion zone segments 108 permits control of the operation of augmentor 46 and reduction in the complexity of the fuel metering system.

Establishing fluid communication from passageway 124*b* of one spraybar assembly 50 with fuel passageway 124*c* of an adjacent assembly permits propagation of combustion from a single circumferential zone segment 108 to another segment 108. In some embodiments of the present invention it may also be useful to place in fluid communication fuel passageways 124*b* and 124*c* of a single spraybar assembly 50 such that combustion is propagated along both sides of radial member 100 of the particular assembly 50. Providing fuel to passageway 124*a* results in combustion within inner cylinder 109. As shown in FIG. 2 in cross hatch, providing fuel to a passageway 124*a* of a single spraybar assembly 50 results in combustion within a radial combustion zone 110. In other embodiments of the present invention, fuel passageways 124*a,* 124*b,* and 124*c* are in fluid communication. In still other embodiments of the present invention a plurality of fuel passageways 124*a,* or in one embodiment all fuel passageways 124*a,* are in fluid communication so as to result in more than seventeen discrete levels of afterburner operation. Passageways 124 may be brought into fluid communication in other ways as would be known to one of ordinary skill of the art.

In some embodiments of the present invention there is no need for a separate source of ignition for fuel sprayed into flowpath 47. Lateral members 102 and 104 can be constructed so as to have surface temperatures high enough to support autoignition of fuel touching the surfaces of members 102 or 104. Further, the junction of radial member 100 with lateral member 102 and 104 at nose 138 provides sufficient disruption and local deceleration of flowpath 47 so as to act as a flameholder. Nose 138 assists in stabilizing the combustion process within augmentor 46. Thus, fuel can be sprayed from an individual spraybar assembly 50 without the necessity for that particular spraybar assembly to be located near an igniter. In addition, augmentor 46 can be operated without the expense and weight of separate flameholders downstream of spraybar assemblies 50 because of the flameholding of nose 138.

Some embodiments of the present invention permit improved packaging of afterburning portion 46 that is possible with spraybar assembly 50. The use of lateral arms 102 and 104 permit a reduction in the radial length of radial member 100 while retaining the ability to spray sufficient quantities of fuel into the engine into flowpath 47. Thus, spraybar assembly 50 is relatively compact and does not extend deeply toward center line 49 of engine 40. Spraybar assemblies 50 can thus be located in the general vicinity of bearing cover 53, and not necessarily aft of cover 53. The close proximity of assembly 50 to exit vanes 51 and bearing cover 53 permits a significant reduction in the overall length and weight of afterburning portion 46. Also, the use of lateral members 102 and 104 for spraying of fuel results in fewer penetrations of casings 60 and 62, thus reducing the complexity and increasing the strength of casings 60 and 62.

Some embodiments of the present invention may also produce a shifting of the centerline of the engine thrust away from centerline 49 when there is combustion within one or more contiguous segments 108 and/or 110, and no combustion within the segments 108 and/or 110 generally on the opposite side of augmentor 46. This localized and asymmetric combustion increases gas temperature and gas velocity locally within flowpath 47. This asymmetric profile of the exhaust gas results in an off-centerline thrust, or thermal thrust vectoring, as the gas is accelerated through nozzle 48. By creating an asymmetry in combustion from top to bottom of the engine, it is possible to vector the thrust so as to apply a pitching moment to the engine and the vehicle. By creating an asymmetry in combustion from the right side to the left side of the engine, a side to side vectoring of thrust is created that applies a yawing moment to the engine and vehicle. Also, the combustion may be asymmetrically staged so as to apply combined pitching and yawing moments to the engine and vehicle. Thus, the present invention can provide thermal thrust vectoring to the engine and vehicle, and does not rely upon a complicated mechanical arrangement of actuators and movable nozzle flaps for thrust vectoring.

Figure 20:
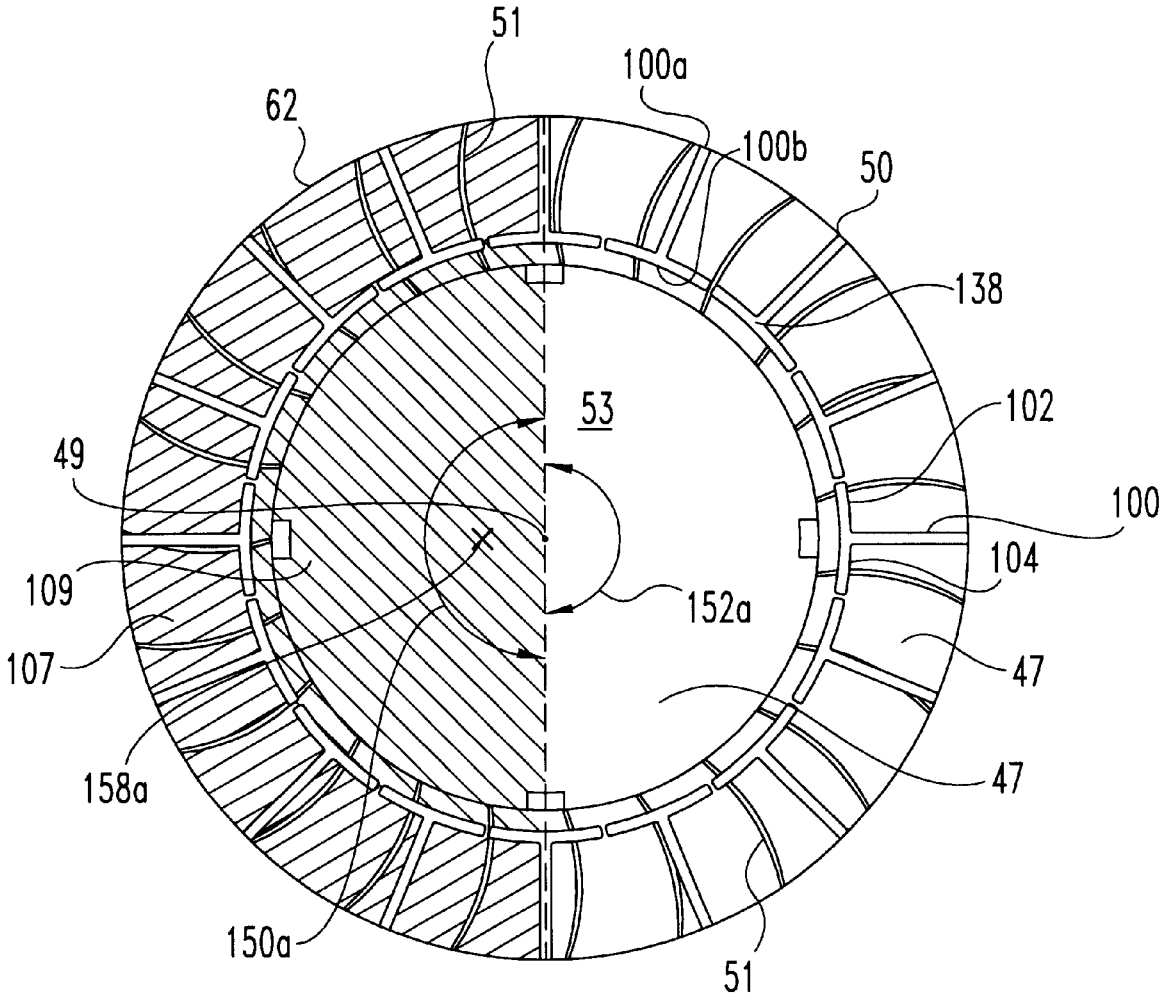
FIG. 20 is an elevational end view of the gas turbine engine of FIG. 1 as taken along line 2—2 of FIG. 1 depicting thermal thrust vectoring.

FIG. 20 depicts in cross-hatching a first portion 150*a* of flowpath 47 in which a first quantity of fuel is being sprayed by a plurality of spraybars 50. A second quantity of fuel from a plurality of spraybars 50 is being sprayed within a second portion 152*a* of flowpath 47. The second quantity of fuel is less than about one-half of the first quantity of fuel, and preferably is zero, such that no fuel is sprayed by spraybars 50 within second portion 152*a*.

As shown in FIG. 20, fuel is being sprayed in first portion 150*a* of flowpath 47, which is an arc equal to about 180° of flowpath 47 about geometric centerline 49. Second portion 152*a* is the complementary portion of flowpath 47, and is equal to about 180°. Because of this asymmetric distribution of fuel, the portion of the flowpath downstream of first portion 150*a* is hotter than the portion of flowpath 47 downstream of portion 152*a*. As flowpath 47 flows into throat 154 of nozzle 48, the velocity of gases within flowpath 47 increase to sonic velocity. As the gases of flowpath 47 exit from throat 154 and pass into divergent section 156, the sonic velocity gases accelerate to supersonic velocity. The hot gases downstream of portion 150*a* of flowpath 47 accelerate to higher velocity than the gases downstream of second portion 152*a*. The greater velocity of gases downstream of first portion 150*a* creates more thrust than the gases downstream of second portion 152*a*. Thus, the thrust centerline 158*a* of flowpath 47 shifts laterally away from the geometric center 49 of flowpath 47, the difference between the first quantity of fuel and the second quantity of fuel causing the thrust of the engine to thermally vector. This shift of thrust centerline 158*a* creates a yawing moment on the engine and the vehicle.

Figure 21:
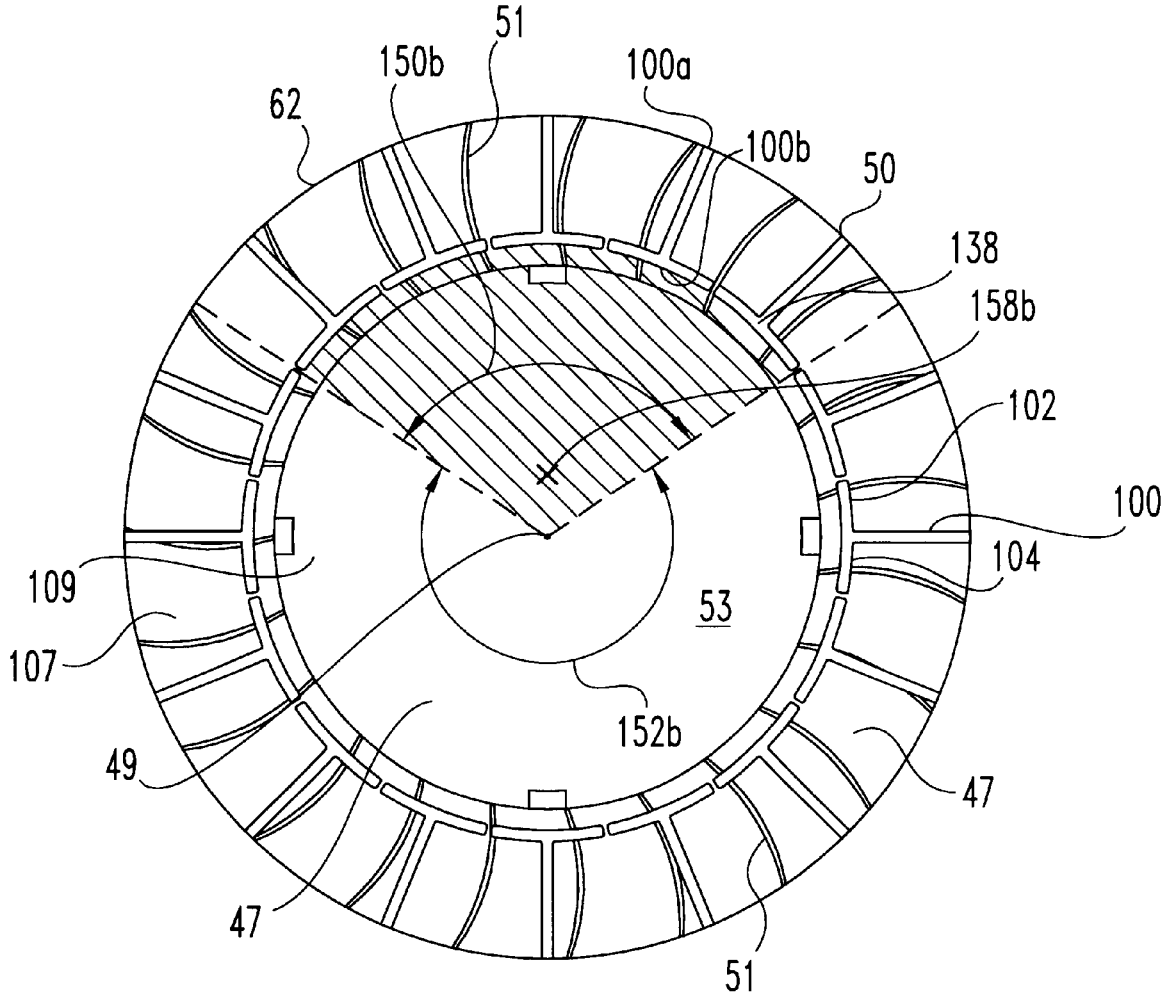
FIG. 21 is an elevational end view of the gas turbine engine of FIG. 1 as taken along line 2—2 of FIG. 1 depicting thermal thrust vectoring.

FIG. 21 shows another embodiment of the present invention in which a first quantity of fuel is delivered or sprayed into a first portion 150*b* of flowpath 47. A second quantity of fuel less than about half the first quantity, and preferably zero, is delivered into a second portion 152*b* of flowpath 47. First portion 150*b* is generally centered about a vertical plane of symmetry of flowpath 47. Because of the difference in the temperature of gases downstream of portion 150*b* and 152*b* as a result of the difference between the first quantity of fuel and the second quantity of fuel, thrust centerline 158*b* shifts vertically from geometric centerline 49. This offset of the thrust centerline creates a pitching moment about the engine and vehicle.

Figure 22:
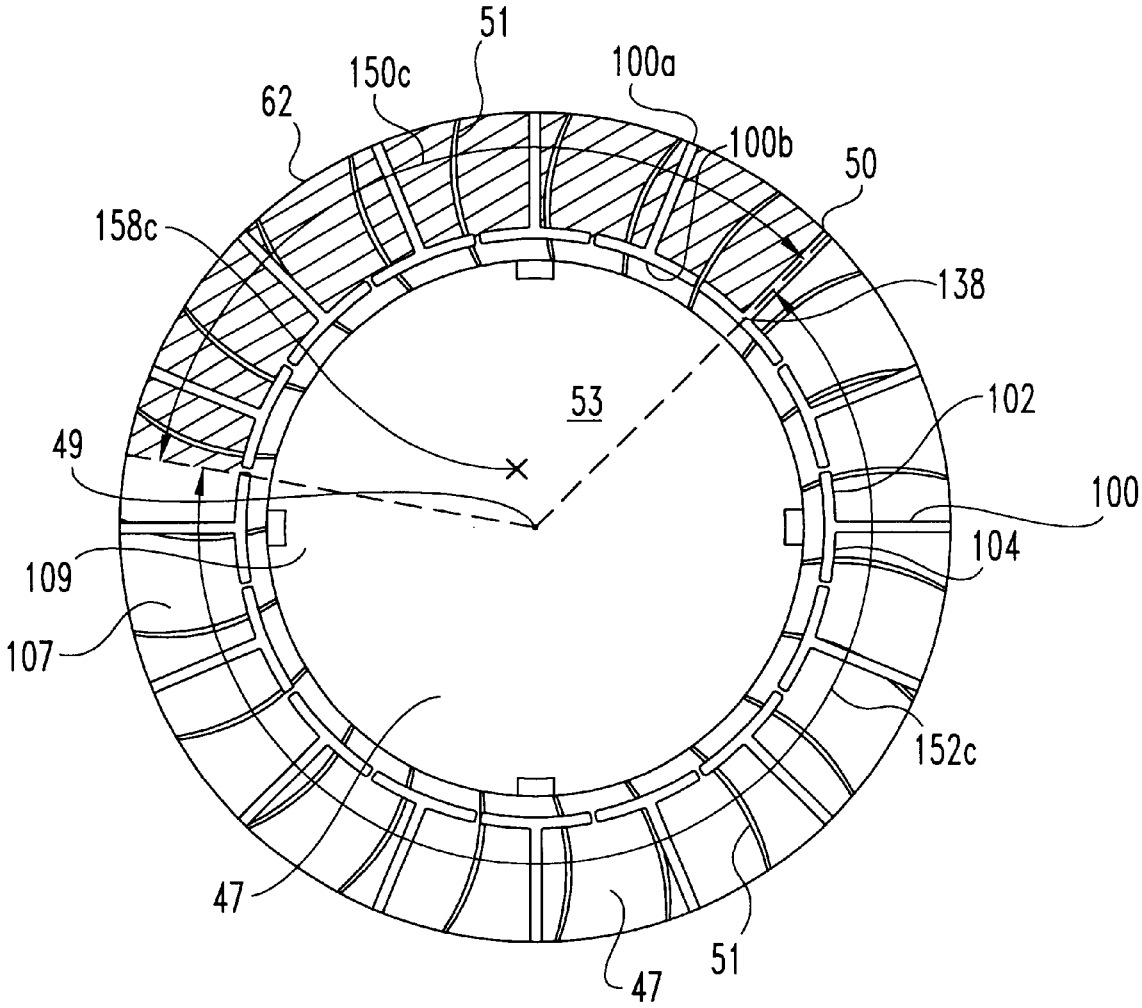
FIG. 22 is an elevational end view of the gas turbine engine of FIG. 1 as taken along line 2—2 of FIG. 1 depicting thermal thrust vectoring.

FIG. 22 shows another embodiment of the present invention in which a first quantity of fuel is sprayed within a partial outer annulus of a first portion 150*c* of flowpath 47. A second quantity of fuel is sprayed within second portion 152*c*, such that the second quantity of fuel is less than half the first quantity of fuel, and preferably zero fuel. First portion 150*c* extends over a portion of the top and left side of flowpath 47. Thrust centerline 158*c* shifts both vertically and laterally so as to create a combined pitching and yawing moment on the engine and the vehicle.

As shown in FIGS. 20, 21 and 22, the first portion of flowpath 47 into which a first quantity of fuel is delivered may be located within various areas within flowpath 47. The first portion may include one or more circumferential combustion zone segments 108 as depicted in FIG. 22, one or more radial combustion zone segments 110 as shown in FIG. 21, or a combination of one or more circumferential and radial combustion zone segments as shown in FIG. 20. In addition, the first portion may be located so as to produce yawing, pitching, or combined pitching or yawing moments. To achieve the maximum shifting of the thrust centerline away from the geometric centerline of the engine, it is preferable to introduce a first quantity of fuel that results in localized stoichiometric combustion, with no fuel introduced into the complementary second portion of the flowpath. The present invention also includes those embodiments in which a first quantity of fuel less than that needed for stoichiometric combustion is introduced, and in which the second quantity of fuel is non-zero.

Figure 10:
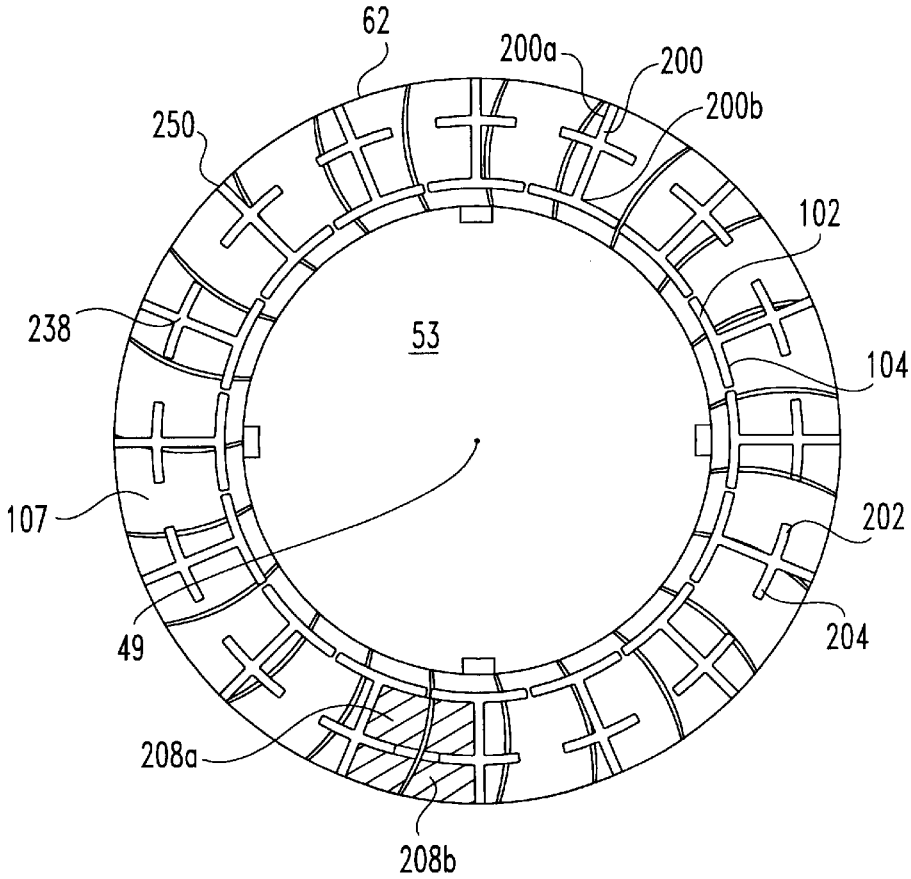
FIG. 10 is an elevational end view of the gas turbine engine of FIG. 1 showing a portion of another embodiment of a spraybar assembly in accordance with the present invention.

FIG. 10 is an elevational end view of the gas turbine engine of FIG. 1 showing a portion of another embodiment of a spraybar assembly in accordance with the present invention. The use of the same numbers as previously used denotes elements substantially similar to those previously described. A plurality of radial members 200 from a plurality of spraybar assemblies 250 are shown extending through inner casing 62 into flowpath 47. Each radial member 200 protrudes through casing 62 at an outermost end 200*a* and includes first and second lateral members 102 and 104 located generally at innermost end 200*b*. Intermediate of outermost end 200*a* and innermost end 200*b* are third and fourth lateral arms 202 and 204, respectively. Third lateral member 202, fourth lateral member 204 and radial member 200 meet at second nose 238, nose 238 providing flameholding for locally combusted gases.

Figure 11:
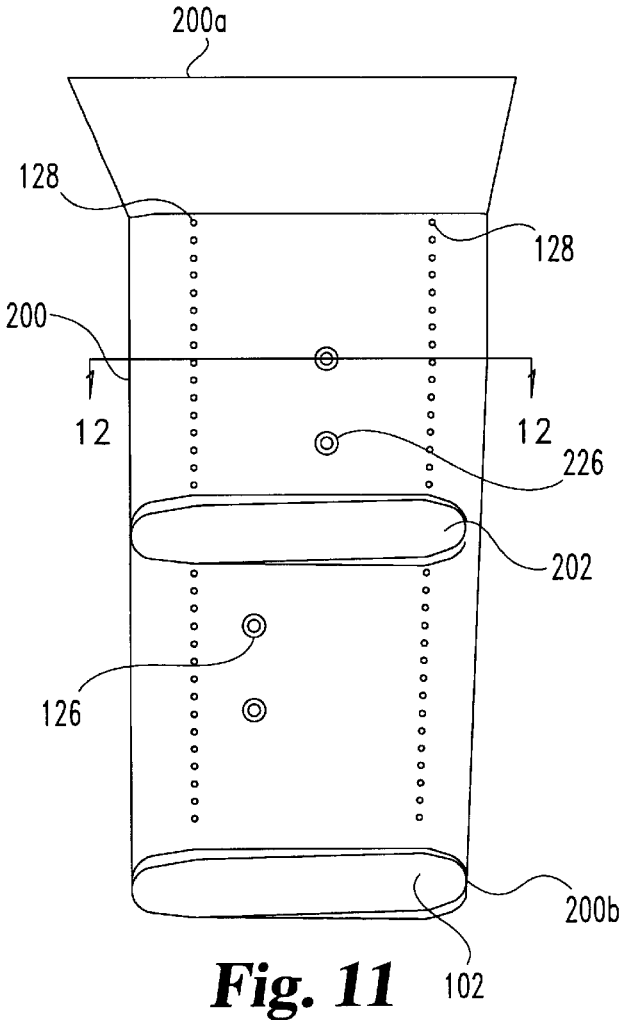
FIG. 11 is a side elevational view of the portion of the spraybar assembly of FIG. 10 that protrudes into the flowpath.

FIG. 11 is a side elevational view of the portion of spraybar assembly 250 that protrudes into flowpath 47. Located between outermost end 200*a* and innermost end 200*b* of radial member 200 are a plurality of exhaust holes 128 which exhaust cooling air into flowpath 47. A first set of lateral fuel spray passages 126 are located along radial member 200 between third lateral member 202 and first lateral member 102. A third set of lateral fuel spray passages 226 are located between third lateral member 202 and outermost end 200*a*.

Figure 12:
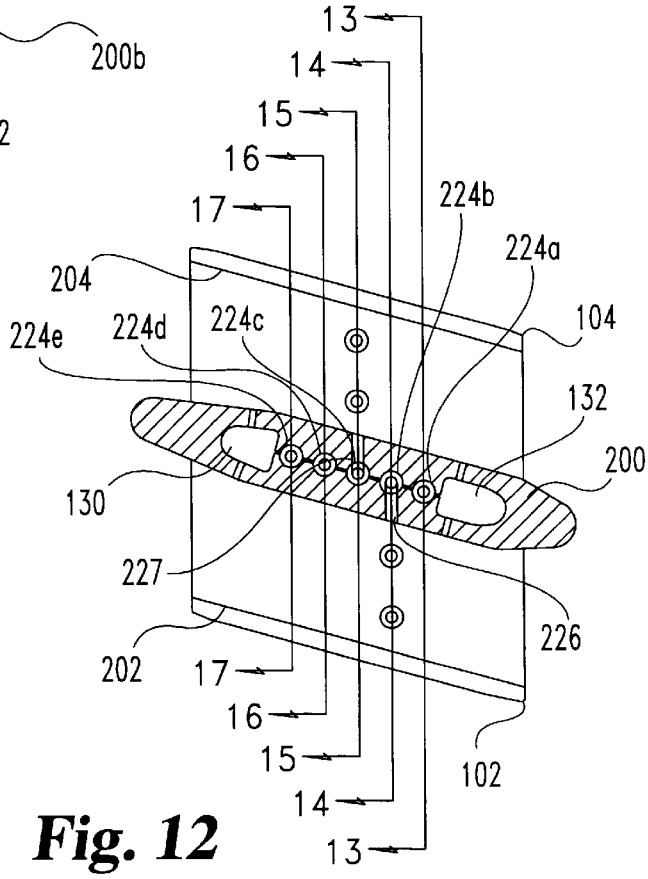
FIG. 12 is a view of the apparatus of FIG. 11 as taken along line 12—12 of FIG. 11.

FIG. 12 is a view of the apparatus of FIG. 11 as taken along line 12—12 of FIG. 11. Fourth lateral member 204 is located along radial member 200 in a position generally intermediate of second lateral member 104 and outermost end 200*a*. Fourth lateral member 204 is generally opposite of and aligned with third lateral member 202. Forward cooling air channel 130 and aft cooling air channel 132 are located within radial member 200 and provide cooling air to exhaust holes 128. There are five fuel passageways 224 for providing a flow of fuel from the exterior portion of spraying assembly 250 and through the upper body.

Figure 13:
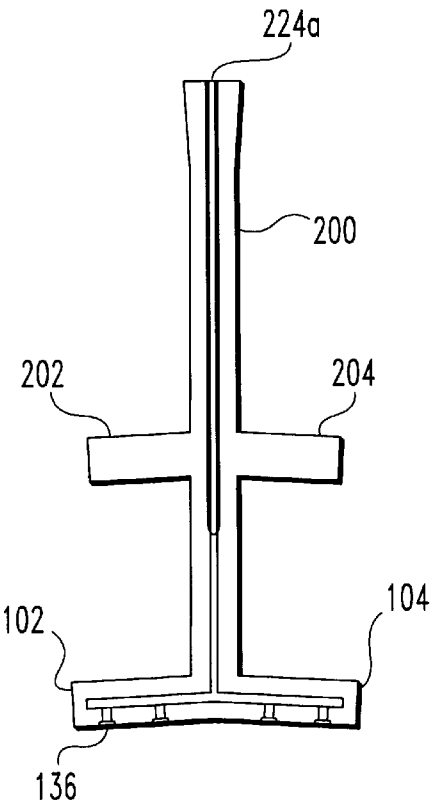
FIG. 13 is a cross-sectional view of the apparatus of FIG. 12 as taken along line 13-13 of FIG. 12.

FIG. 13 is a cross-sectional view of the apparatus of FIG. 12 as taken along line 13—13 of FIG. 12. Fuel passageway 224*a* is shown in fluid communication with a plurality of lower radial fuel spray passages 136 along the radially innermost surface of lateral members 102 and 104.

Figure 14:
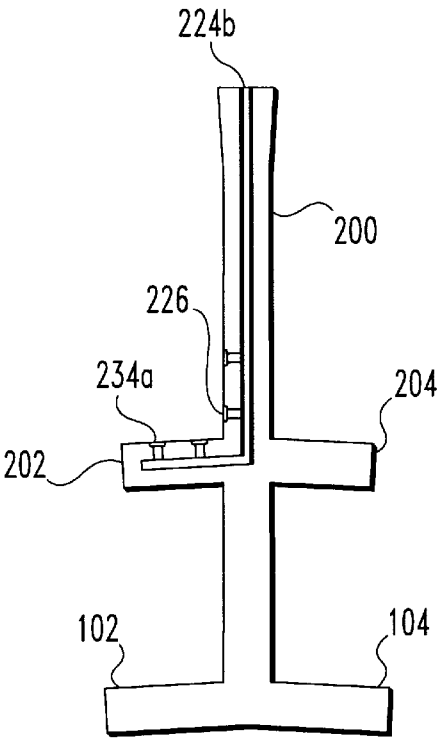
FIG. 14 is a cross-sectional view of the apparatus of FIG. 12 as taken along line 14—14 of FIG. 12.

FIG. 14 is a cross-sectional view of the apparatus of FIG. 12 as taken along line 14—14 of FIG. 12. Fuel passage 224*b* is shown in fluid communication with a third set of lateral fuel spray passages 226 located along radial member 200 and radially outward of lateral member 202, and outward radial fuel spray passages 234*a* located along the radially outwardmost surface of lateral member 202.

Figure 15:
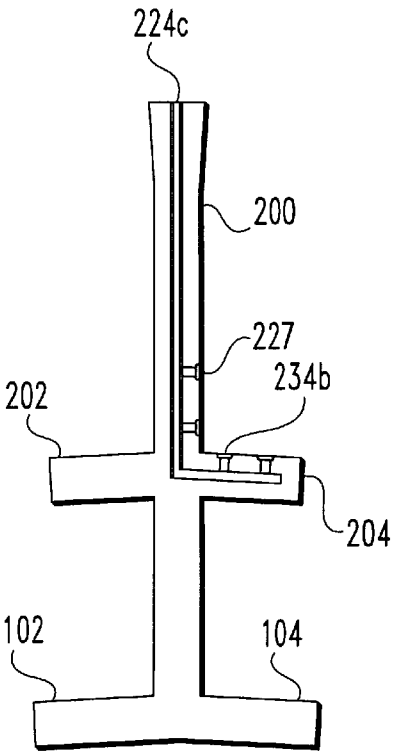
FIG. 15 is a cross-sectional view of the apparatus of FIG. 12 as taken along line 15—15 of FIG. 12.

FIG. 15 is a cross-sectional view of the apparatus of FIG. 12 as taken along line 15—15 of FIG. 12. Fuel passage 224*c* is shown in fluid communication with a fourth set of lateral fuel spray passages 227 located along radial member 200 and radially outward of lateral member 204, and outward radial fuel spray passages 234*b* located along the radially outwardmost surface of lateral member 204.

Figure 16:
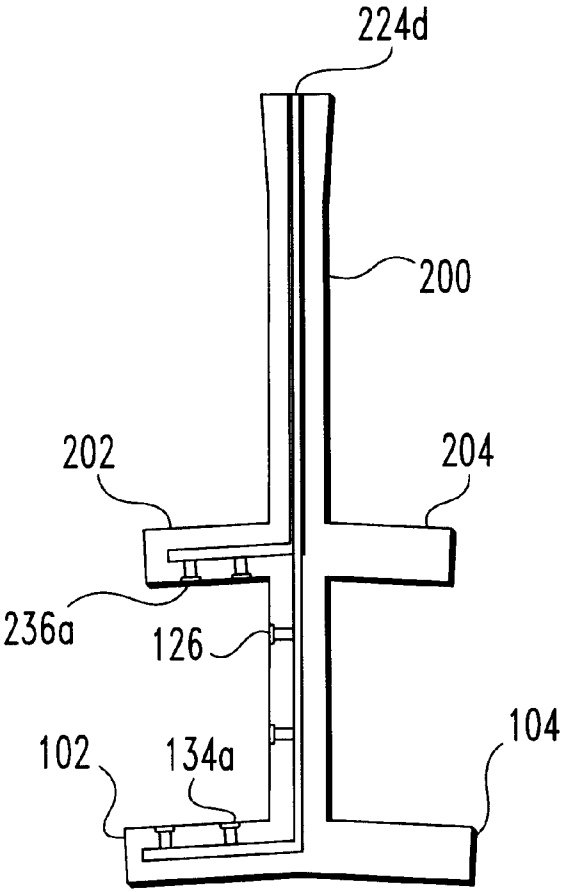
FIG. 16 is a cross-sectional view of the apparatus of FIG. 12 as taken along line 16—16 of FIG. 12.

FIG. 16 is a view of the apparatus of FIG. 12 as taken along line 16—16 of FIG. 12. Fuel passageway 224*d* is shown in fluid communication with first set of lateral fuel spray passages 126, inner intermediate radial spray passages 236*a*, and outer radial fuel spray passages 134*a*. Spray passages 236*a* are located on third lateral member 202 and for spraying fuel in a generally radially inward direction.

Figure 17:
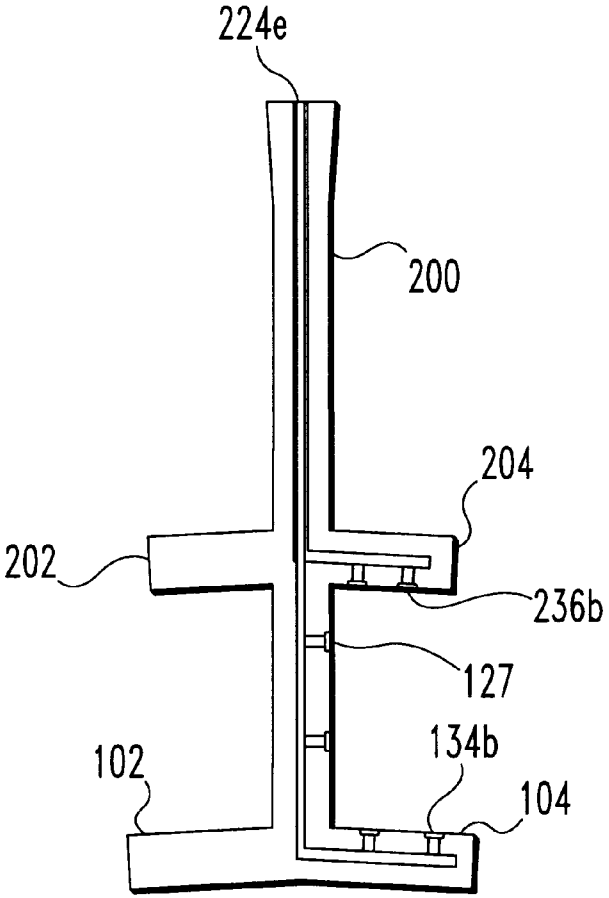
FIG. 17 is a cross-sectional view of the apparatus of FIG. 12 as taken along line 17—17 of FIG. 12.

FIG. 17 is a cross-sectional view of the apparatus of FIG. 12 as taken along line 17—17 of FIG. 12. Fuel passageway 224*e* is shown in fluid communication with second set of lateral fuel spray passages 127, inner intermediate radial spray passages 236*b*, and outer radial fuel spray passages 134*b*. Spray passages 236*b* are located on third lateral member 204 and are useful for spraying fuel in a generally radially inward direction.

Figure 18:
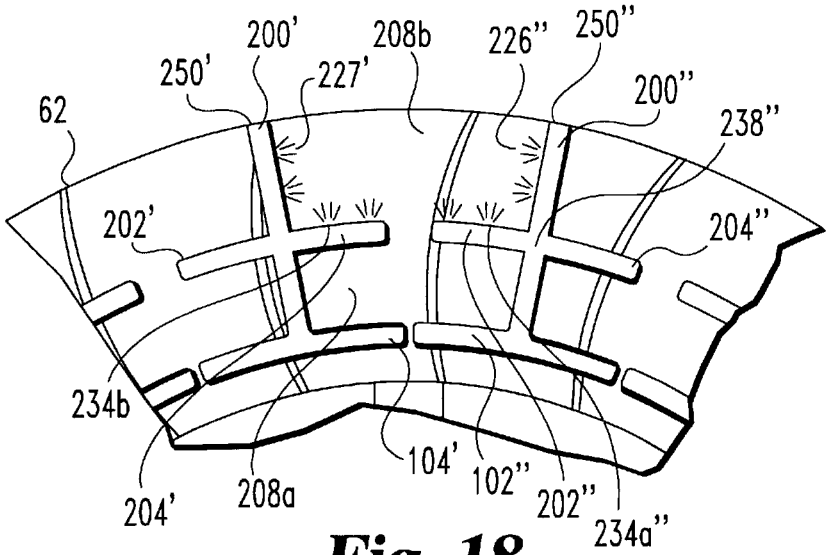
FIG. 18 is an enlarged portion of an end elevational view showing portions of two of the fuel spraybar assemblies of FIG. 10.

FIG. 18 is an enlarged portion of a view similar to FIG. 9 showing portions of two fuel spray bar assemblies 250 useful with the present invention. A portion of a first spraybar assembly 250' is shown spaced circumferentially from a second spraybar assembly 250". A first radial member 200' protrudes past inner casing 62 into flowpath 47. In one embodiment of the present invention fuel passageways 224*c'* and 224*b"* (not shown) are in fluid communication. Fuel has been provided to fuel passageway 224*c'*, and is shown spraying from second set of lateral fuel spray passages 227' and upper radial fuel spray passages 234*b'*. Fuel has also been provided to fuel passageway 224*b"* of assembly 250", and fuel is shown spraying from first sets of lateral fuel spray passages 226" and upper radial fuel spray passages 234*a"*. By providing fuel to passageways 224*c'* and 224*b"*, combustion occurs within an outer circumferential combustion zone 208*b* which is bounded generally by radial member 200', second lateral member 204', first lateral member 202", radial member 200", and inner casing 62.

In the embodiment of the present invention shown in FIG. 18, there are sixteen inner circumferential combustion zone segments 208*a* and sixteen outer circumferential combustion zone segments 208*b*. Flowpath 47 of engine 40 within afterburning portion 46 is divided into an outer annulus 107 and inner cylinder 109. Inner casing 62 and lateral members 102 and 104 define the outer and inner boundaries, respectively, of outer annulus 107. Radial members 200 further subdivide first outer annulus 107 into a plurality of circumferentially extending combustion zone segments 208. Lateral members 202 and 204 further subdivide each combustion zone segment 208 into outer zone segments 208*b* and inner zone segments 208*a*.

Figure 19:
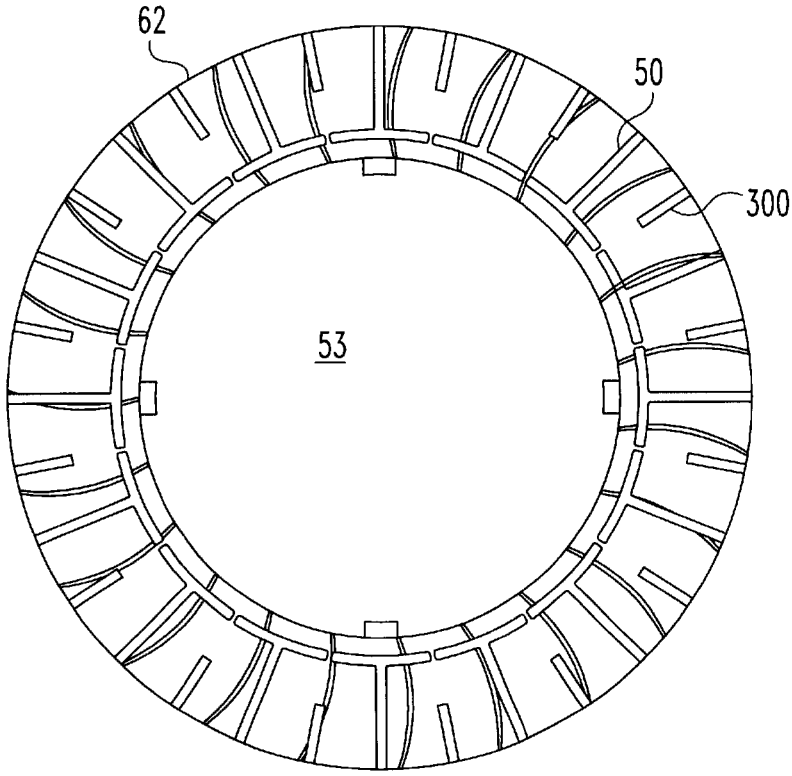
FIG. 19 is an elevational end view of a gas turbine engine showing a third embodiment of the present invention.

FIG. 19 shows a third embodiment of the present invention in which a plurality of secondary radial members 300 are placed between adjacent spraybar assemblies 50. Radial members 300 include spray passages for spraying fuel in a generally circumferential direction within a combustion zone segment 108.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for changing the direction of a vehicle, comprising:

providing a vehicle with a gas turbine engine including an afterburner, the afterburner having a flowpath with a centerline and a plurality of fuel spraybars disposed therein;

propelling the vehicle in a first direction with thrust from the gas turbine engine, the afterburner being fueled by the plurality of fuel spraybars in a first fuel distribution field;

selecting to propel the vehicle in a second direction distinct from the first direction;

distributing fuel asymmetrically within the flowpath from the plurality of fuel spraybars to define a second fuel distribution field within the afterburner different from the first fuel distribution field; and burning the fuel within the second fuel distribution field to an create an off-centerline thrust to modify the direction of the vehicle.

2. The method of claim 1, wherein the flowpath has a top and a bottom, and wherein said distributing creates a fuel asymmetry from the top to the bottom, and wherein said burning results in an off-centerline thrust that applies a pitching moment to the vehicle.

3. The method of claim 1, wherein the flowpath has a first side and a second side and wherein said distributing creates a fuel asymmetry from the first side to the second side, and wherein said burning results in an off-centerline thrust that applies a yawing moment to the vehicle.

4. The method of claim 1, wherein the flowpath has a first side, a second side, a top and a bottom, and wherein said distributing creates a fuel asymmetry from the first side to the second side and from the top to the bottom, and wherein said burning results in an off-centerline thrust that applies a combined pitching and yawing moment to the vehicle.

5. The method of claim 1, wherein in said distributing a portion of the flowpath receives no fuel from the plurality of fuel spraybars.

6. The method of claim 1, wherein at least one of the plurality of spraybars does not deliver fuel into the flowpath during said distributing.

7. The method of claim 1, wherein said distributing introduces a quantity of fuel within a portion of the flowpath that results in localized stoichiometric combustion during said combustion.

8. The method of claim 1, wherein each of the plurality of fuel spraybars includes a selectively operable radial member adapted for the generally circumferential distribution of fuel and a selectively operable lateral member adapted for the generally radial distribution of fuel.

9. The method of claim 1, which further includes a convergent divergent nozzle in flow communication with the flowpath, the convergent nozzle receiving the asymmetric exhaust gas profile from said burning.

10. The method of claim 4, wherein in said distributing a portion of the flowpath receives no fuel from the plurality of fuel spraybars; and wherein each of the plurality of fuel spraybars includes a selectively operable radial member adapted for the generally circumferential distribution of fuel and a selectively operable lateral member adapted for the generally radial distribution of fuel.

11. The method of claim 1, wherein each of the plurality of fuel spraybars includes means for preventing coking therein.

* * * * *